US007994932B2

(12) United States Patent
Huang et al.

(10) Patent No.: US 7,994,932 B2
(45) Date of Patent: Aug. 9, 2011

(54) BOREHOLE TELEMETRY SYSTEM

(75) Inventors: Songming Huang, Hardwick (GB); Franck Monmont, Caldecote (GB); Robert Tennent, Lower Cambourne (GB)

(73) Assignee: Schlumberger Technology Corporation, Ridgefield, CT (US)

( * ) Notice: Subject to any disclaimer, the term of this patent is extended or adjusted under 35 U.S.C. 154(b) by 547 days.

(21) Appl. No.: 10/549,277

(22) PCT Filed: Mar. 24, 2004

(86) PCT No.: PCT/GB2004/001281

§ 371 (c)(1),
(2), (4) Date: May 19, 2006

(87) PCT Pub. No.: WO2004/085796

PCT Pub. Date: Oct. 7, 2004

(65) Prior Publication Data

US 2007/0030762 A1 Feb. 8, 2007

(30) Foreign Application Priority Data

Mar. 26, 2003 (GB) ..... 0306929.1

(51) Int. Cl.
*G01V 1/00* (2006.01)

(52) U.S. Cl. ..... 340/854.3; 340/853.4; 367/81; 367/83

(58) Field of Classification Search ..... 367/81–83; 340/854.3, 853.4
See application file for complete search history.

(56) References Cited

U.S. PATENT DOCUMENTS

| | | | | |
|---|---|---|---|---|
| 3,659,259 | A | 4/1972 | Chaney, Jr. et al. | |
| 3,742,443 | A | 6/1973 | Foster et al. | |
| 3,747,059 | A | 7/1973 | Garcia | |
| 3,906,434 | A | 9/1975 | Lamel et al. | |
| 3,909,775 | A * | 9/1975 | Lavigne | 367/32 |
| 3,964,556 | A | 6/1976 | Gearhart et al. | |
| 5,160,925 | A | 11/1992 | Dailey et al. | |
| 5,253,099 | A | 10/1993 | Heidemann | |
| 5,283,768 | A | 2/1994 | Rorden | |
| 5,444,324 | A * | 8/1995 | Priest et al. | 310/334 |
| 5,592,438 | A | 1/1997 | Rorden et al. | |
| 5,598,050 | A | 1/1997 | Bowen et al. | |
| 5,850,369 | A | 12/1998 | Rorden et al. | |
| 6,208,586 | B1 | 3/2001 | Rorden et al. | |
| 6,320,820 | B1 | 11/2001 | Gardner et al. | |
| 6,442,105 | B1 | 8/2002 | Tubel et al. | |
| 6,757,218 | B2 * | 6/2004 | Dubinsky | 367/83 |
| 2002/0180613 | A1 * | 12/2002 | Shi et al. | 340/853.1 |

(Continued)

FOREIGN PATENT DOCUMENTS

EP 0393988 A2 10/1990

(Continued)

*Primary Examiner* — Timothy Edwards, Jr.
*Assistant Examiner* — Hung Q Dang
(74) *Attorney, Agent, or Firm* — Helene Raybaud; Brigid Laffey

(57) ABSTRACT

An acoustic telemetry apparatus and method for communicating encoded digital data from a down-hole location through a borehole to the surface is described including an acoustic channel terminated at a down-hole end by a reflecting terminal (133, 134), an acoustic wave generator (140) located at the surface and providing an acoustic wave carrier signal through said acoustic, channel, a modulator (162, 163) located down-hole to modulate amplitude and/or phase of said carrier wave in response to an encoded digital signal and one or more sensors (150) located at the surface adapted to detect amplitude and/or phase related information of acoustic waves traveling within said acoustic channel to determine the encoded digital data.

30 Claims, 9 Drawing Sheets

U.S. PATENT DOCUMENTS

| | | | |
|---|---|---|---|
| 2003/0015319 | A1 | 1/2003 | Green et al. |
| 2003/0086336 | A1 | 5/2003 | Dubinsky |

FOREIGN PATENT DOCUMENTS

| | | | |
|---|---|---|---|
| GB | 2140599 | A | 11/1984 |
| GB | 2317955 | A | 4/1998 |
| GB | 2 351 423 | A | 12/2000 |
| RU | 27153 | U1 | 1/2003 |
| SU | 514257 | A | 6/1976 |

* cited by examiner

FIG. 4A
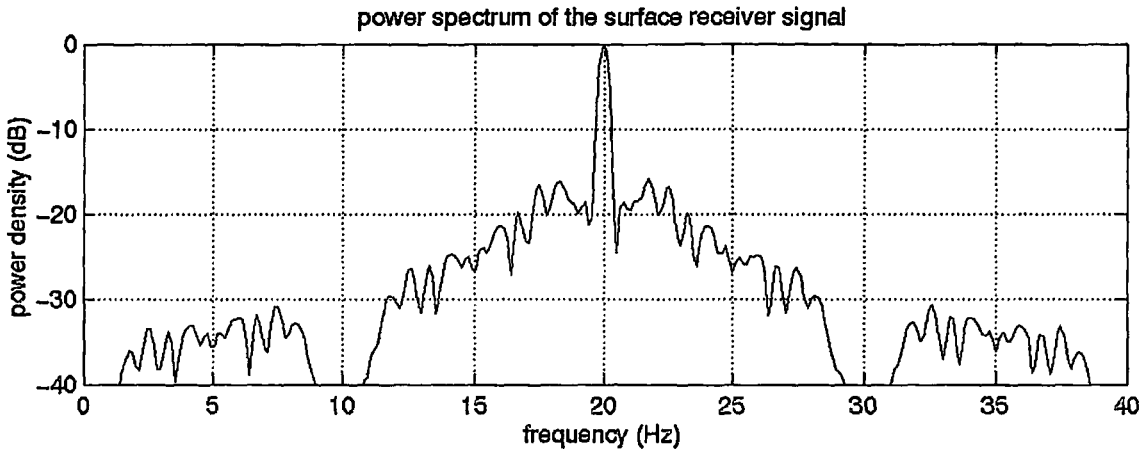
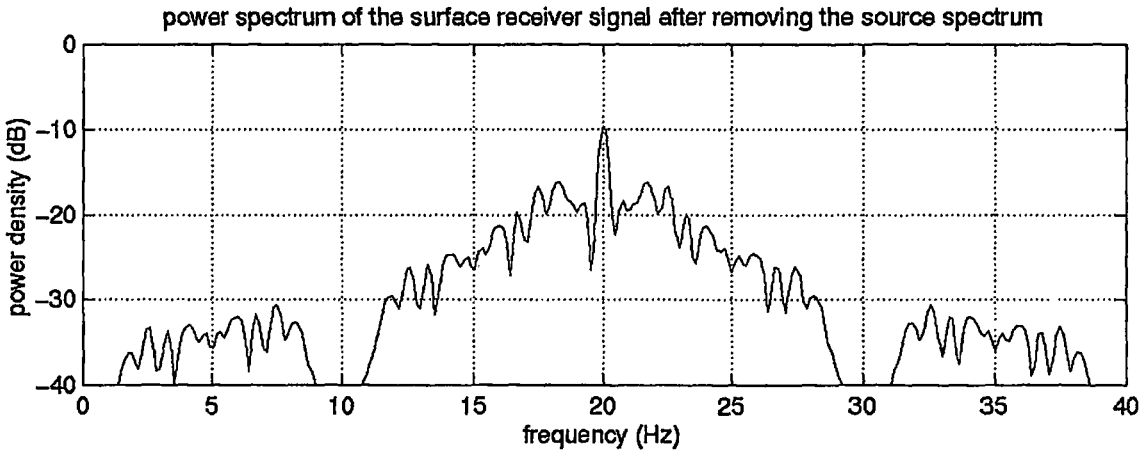
FIG. 4B

BOREHOLE TELEMETRY SYSTEM

The present invention generally relates to an apparatus and a method for communicating parameters relating to down-hole conditions to the surface. More specifically, it pertains to such an apparatus and method for acoustic communication.

BACKGROUND OF THE INVENTION

One of the more difficult problems associated with any borehole is to communicate measured data between one or more locations down a borehole and the surface, or between down-hole locations themselves. For example, communication is desired by the oil industry to retrieve, at the surface, data generated down-hole during operations such as perforating, fracturing, and drill stem or well testing; and during production operations such as reservoir evaluation testing, pressure and temperature monitoring. Communication is also desired to transmit intelligence from the surface to down-hole tools or instruments to effect, control or modify operations or parameters.

Accurate and reliable down-hole communication is particularly important when complex data comprising a set of measurements or instructions is to be communicated, i.e., when more than a single measurement or a simple trigger signal has to be communicated. For the transmission of complex data it is often desirable to communicate encoded digital signals.

One approach which has been widely considered for borehole communication is to use a direct wire connection between the surface and the down-hole location(s). Communication then can be made via electrical signal through the wire. While much effort has been spent on "wireline" communication, its inherent high telemetry rate is not always needed and very often does not justify its high cost.

Another borehole communication technique that has been explored is the transmission of acoustic waves. Whereas in some cases the pipes and tubulars within the well can be used to transmit acoustic waves, commercially available systems utilize the various liquids within a borehole as the transmission medium.

Among those techniques that use liquids as medium are the well-established Measurement-While-Drilling or MWD techniques. A common element of the MWD and related methods is the use of a flowing medium, e.g., the drilling fluids pumped during the drilling operation. This requirement however prevents the use of MWD techniques in operations during which a flowing medium is not available.

In recognition of this limitation various systems of acoustic transmission in a liquid independent of movement have been put forward, for example in the U.S. Pat. No. 3,659,259; 3,964,556; 5,283,768 or 6,442,105. Most of these known approaches are either severally limited in scope and operability or require down-hole transmitters that consume a large amount of energy.

It is therefore an object of the present invention to provide an acoustic communication system that overcomes the limitations of existing devices to allow the communication of data between a down-hole location and a surface location.

SUMMARY OF THE INVENTION

In accordance with a first aspect of the invention, there is provided an acoustic telemetry apparatus for communicating digital data from a down-hole location through a borehole to the surface comprising an acoustic channel terminated at a down-hole end by a reflecting terminal, an acoustic wave generator located at the surface and providing an acoustic wave carrier signal through said acoustic channel, a modulator to modulate amplitude and/or phase of said carrier wave in response to a digital signal and one or more sensors located at the surface adapted to detect amplitude and/or phase related information of acoustic waves traveling within said acoustic channel.

The new system allows the communication of encoded data that may contain the results of more than one or two different types of measurements, such as pressure and temperature.

The acoustic channel used for the present invention is preferably a continuous liquid-filled channel. Often it is preferable to use a low-loss acoustic medium, thus excluding the usual borehole fluids that are often highly viscous. Preferable media include liquids with viscosity of less than $3\times10^{-3}$ $NS/m^2$, such as water and light oils.

The modulator includes preferably a Helmholtz-type resonator having an tubular opening to the acoustic channel in the vicinity of the reflecting terminal. The modulator is preferably used to close or open the opening thus changing the phase and/or amplitude of the reflected signal. The reflecting terminal can have various shapes, including a solid body that closes the acoustic channel, provided it is rigid and therefore constitutes good reflector for the incoming wave.

The acoustic source at the surface preferably generates a continuous or quasi-continuous carrier wave that is reflected at the terminal with controllable phase and/or amplitude shifts induced by the modulator.

In a preferred variant the apparatus may include an acoustic receiver at the down-hole location thus enabling a two-way communication.

The surface-based part of the telemetry system preferably includes signal processing means designed to filter the unreflected (downwards traveling) carrier wave signal from the upwards traveling reflected and modulated wave signals.

To minimize the power consumption of the down-hole apparatus, there are included a further variant of the invention one or more piezoelectric actuators combined with suitable mechanical amplifiers to increase the effective displacement of the actuator system. The energy efficient actuators can be used to control the reflection properties of the reflecting terminal.

Dependence on batteries as source of power for down-hole tools can be further reduced by using an electro-acoustic transducer that regenerates electrical energy from an acoustic wave generated at the surface. This down-hole power generator can be used for various applications, if, however, used in conjunction with other elements of the present invention, it is advantageous to generate the acoustic wave used to produce power down-hole at a frequency separated from the signal carrier frequency used for telemetry.

In accordance with the yet another aspect of the invention, there is provided a method of communicating digital data from a down-hole location through a borehole to surface, the method comprising the steps of establishing an acoustic channel through the borehole and terminating the channel at a down-hole by a reflecting terminal, generating from the surface an acoustic wave carrier signal within the acoustic channel, modulating amplitude and/or phase of the carrier wave in response to a digital signal and detecting at the surface amplitude and/or phase related information of acoustic waves traveling within the acoustic channel.

In a preferred variant of the invention, the method includes the steps of changing the reflecting properties of the reflecting terminal in order to modulate amplitude and/or phase of the carrier wave.

In yet another preferred variant of the above method, a Helmholtz resonator positioned close to the reflecting terminal is used to modulate the reflecting properties of that terminal.

In a further preferred variant of the invention, a base frequency of the carrier wave is matched to a resonant frequency of the Helmholtz resonator. An approximate match can be performed prior to the deployment of the communication system with the knowledge of the dimension and other properties of the resonator. Alternatively or additionally, the carrier wave frequency may be tuned after the deployment of the system, preferably through an optimization process involving the step of scanning through a range of possible carrier frequencies and evaluating the signal strength of the modulated reflected wave signal.

It is seen as an advantage of the present invention that a plurality of down-hole measurements can be performed simultaneously with the resulting measurements being encoded into a digital bit stream that is subsequently used to modulate the carrier wave. The modulated carrier wave travels in direction of the surface where it is registered using appropriate sensors.

These and other aspects of the invention will be apparent from the following detailed description of non-limitative examples and drawings.

BRIEF DESCRIPTION OF THE DRAWINGS

FIGS. 4A,B show simulated signal power spectra as received at a surface location with and without interference of the source spectrum, respectively;

EXAMPLES

Figure 1:
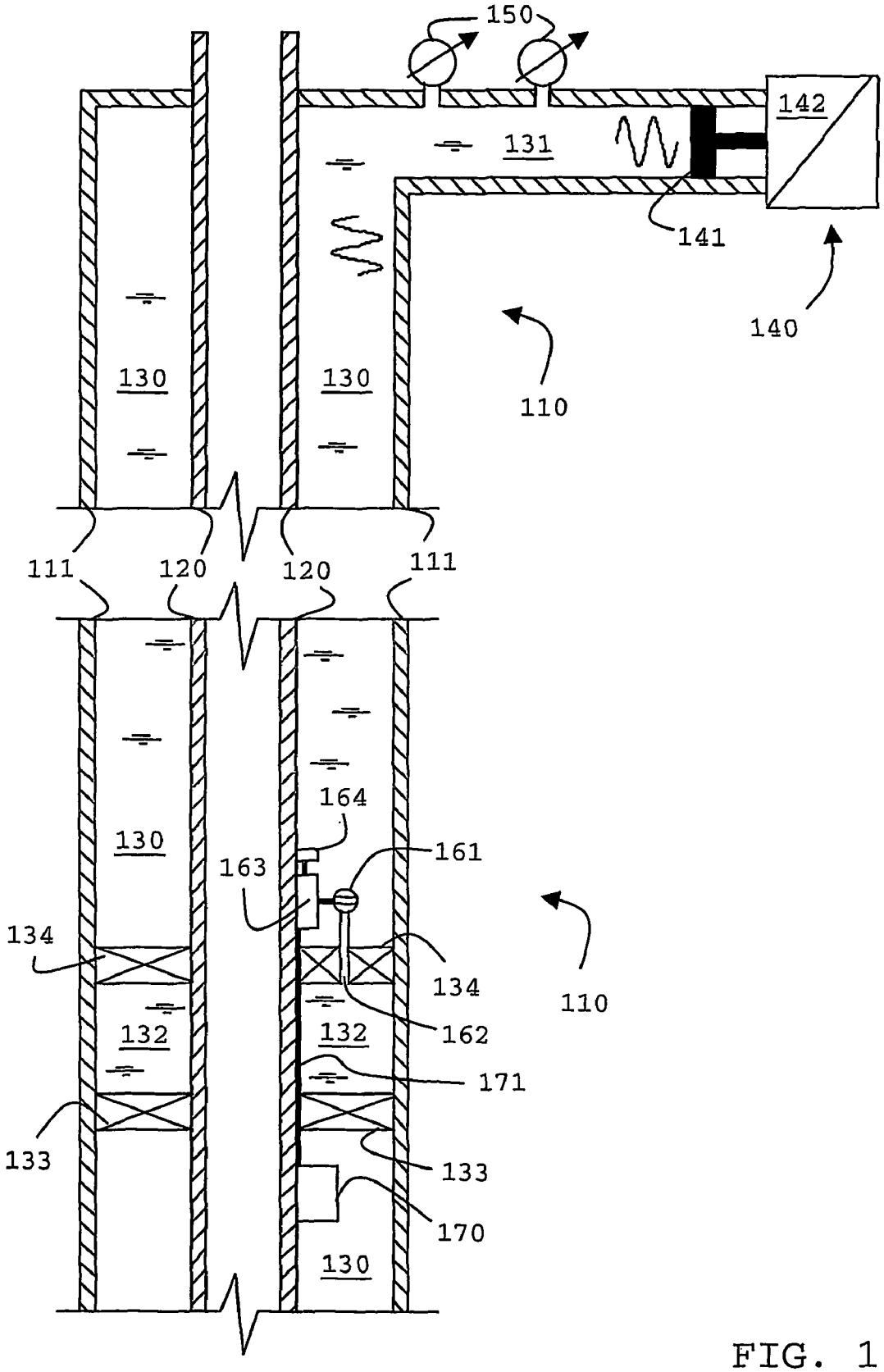
FIG. 1 illustrates elements of an acoustic telemetry system in accordance with an example of the invention.

Referring first to the schematic drawing of FIG. 1, there is shown a cross-section through a cased wellbore 110 with a work string 120 suspended therein. Between the work string 120 and the casing 111 there is an annulus 130. During telemetry operations the annulus 130 is filled with a low-viscosity liquid such as water. A surface pipe 131 extends the annulus to a pump system 140 located at the surface. The pump unit includes a main pump for the purpose of filing the annulus and a second pump that is used as an acoustic wave source. The wave source pump includes a piston 141 within the pipe 131 and a drive unit 142. Further elements located at the surface are sensors 150 that monitor acoustic or pressure waveforms within the pipe 131 and thus acoustic waves traveling within the liquid-filled column formed by the annulus 130 and surface pipe 131.

At a down-hole location there is shown a liquid filled volume formed by a section 132 of the annulus 130 separated from the remaining annulus by a lower packer 133 and an upper packer 134. The packers 133, 134 effectively terminate the liquid filled column formed by the annulus 130 and surface pipe 131 as acoustic waves generated by the source 140 are reflected by the upper packer 134.

The modulator of the present example is implemented as a stop valve 161 that opens or blocks the access to the volume 132 via a tube 162 that penetrates the upper packer 134. The valve 161 is operated by a telemetry unit 163 that switches the valve from an open to a closed state and vice versa.

The telemetry unit 163 in turn is connected to a data acquisition unit or measurement sub 170. The unit 170 receives measurements from various sensors (not shown) and encodes those measurements into digital data for transmission. Via the telemetry unit 163 these data are transformed into control signals for the valve 161.

In operation, the motion of the piston 141 at a selected frequency generates a pressure wave that propagates through the annulus 130 in the down-hole direction. After reaching the closed end of the annulus, this wave is reflected back with a phase shift added by the down-hole data modulator and propagates towards the surface receivers 150.

The data modulator can be seen as consisting of three parts: firstly a zero-phase-shift reflector, which is the solid body of the upper packer 134 sealing the annulus and designed to have a large acoustic impedance compared with that of the liquid filling the annulus, secondly a 180-degree phase shifting (or phase-inverting) reflector, which is formed when valve 161 is opened and pressure waves are allowed to pass through the tube 162 between the isolated volume 132 and the annulus 130 and thirdly the phase switching control device 162, 163 that enables one of the reflectors (and disables the other) according to the binary digit of the encoded data.

In the example the phase-shifting reflector is implemented as a Helmholtz resonator, with a fluid-filled volume 132 providing the acoustic compliance, C, and the inlet tube 162 connecting the annulus and the fluid-filled volume providing an inertance, M, where $$C=V/\rho c^2 \quad [1]$$

and $$M=\rho L/a \quad [2]$$

where V is the fluid filled volume 132, ρ and c are the density and sound velocity of the filling fluid, respectively, and L and a are the effective length and the cross-sectional area of the inlet tube 162, respectively. The resonance frequency of the Helmholtz resonator is then given by:

$$\omega_0=1/(MC)^{0.5}=c(a/(LV))^{0.5} \quad [3]$$

When the source frequency equals $\omega_0$, the resonator presents its lowest impedance at the down-hole end of the annulus.

When the resonator is enabled, i.e, when the valve 161 is opened, its low impedance is in parallel with the high impedance provided by the upper packer 134 and the reflected pressure wave is phase shifted by approximately 180 degrees, and thus effectively inverted compared to the incoming wave.

The value of $\omega_0$ can range from a few Hertz to about 70 Hertz, although for normal applications it is likely to be chosen between 10 to 40 Hz.

The basic function of the phase switching control device, shown as units 163 and 161 in FIG. 1, is to enable and disable the Helmholtz resonator. When enabled, the acoustic impedance at the down-hole end of the annulus equals that of the resonator, and the reflected wave is phase-inverted. When disabled, the impedance becomes that of the packer, and the reflected wave has no phase change. If one assumes that the inverted phase represents binary digit "1", and no phase shift as digit "0", or vice versa, by controlling the switching device with the binary encoded data, the reflected wave becomes a BPSK (binary phase shift key) modulated wave, carrying data to the surface.

The switching frequency, which determines the data rate (in bits/s), does not have to be the same as the source frequency. For instance for a 24 Hz source (and a 24 Hz resonator), the switching frequency can be 12 Hz or 6 Hz, giving a data rate of 12-bit/s or 6-bit/s.

The down-hole data are gathered by the measurement sub 170. The measurement sub 170 contains various sensors or gauges (pressure, temperature etc.) and is mounted below the lower packer 133 to monitor conditions at a location of interest. The measurement sub may further contain data-encoding units and/or a memory unit that records data for delayed transmission to the surface.

The measured and digitized data are transmitted over a suitable communication link 171 to the telemetry unit 163, which is situated above the packer. This short link can be an electrical or optical cable that traverses the dual packer, either inside the packer or inside the wall of the work string 120. Alternatively it can be implemented as a short distance acoustic link or as a radio frequency electromagnetic wave link with the transmitter and the receiver separated by the packers 133, 134.

The telemetry unit 163 is used to encode the data for transmission, if such encoding has not been performed by the measurement sub 170. It further provides power amplification to the coded signal, through an electrical power amplifier, and electrical to mechanical energy conversion, through an appropriate actuator.

For use as a two-way telemetry system, the telemetry unit also accepts a surface pressure wave signal through a down-hole acoustic receiver 164.

A two-way telemetry system can be applied to alter the operational modes of down-hole devices, such as sampling rate, telemetry data rate during the operation. Other functions unrelated to altering measurement and telemetry modes may include open or close certain down-hole valve or energize a down-hole actuator. The principle of down-hole to surface telemetry (up-link) has already been described in the previous sections. To perform the surface to down-hole down link, the surface source sends out a signal frequency, which is significantly different from the resonance frequency of the Helmholtz resonator and hence outside the up-link signal spectrum and not significantly affected by the down-hole modulator.

For instance, for a 20 Hz resonator, the down-linking frequency may be 39 Hz (in choosing the frequency, the distribution of pump noise frequencies, mainly in the lower frequency region, need to be considered). When the down-hole receiver 164 detects this frequency, the down-hole telemetry unit 163 enters into a down-link mode and the modulator is disabled by blocking the inlet 162 of the resonator. Surface commands may then be sent down by using appropriate modulation coding, for instance, BPSK or FSK on the down-link carrier frequency.

The up-link and down-link may also be performed simultaneously. In such case a second surface source is used. This may be achieved by driving the same physical device 140 with two harmonic waveforms, one up-link carrier and one down-link wave, if such device has sufficient dynamic performance. In such parallel transmissions, the frequency spectra of up and down going signals should be clearly separated in the frequency domain.

The above described elements of the novel telemetry system may be improved or adapted in various ways to different down hole operations.

In the example of FIG. 1, the volume 132 of the Helmholtz resonator is formed by inflating the lower main packer 133 and the upper reflecting packer 134, and is filled with the same fluid as that present in the column 130. However as an alternative the Helmholtz resonator may be implemented as a part of dedicated pipe section or sub.

Figure 2:
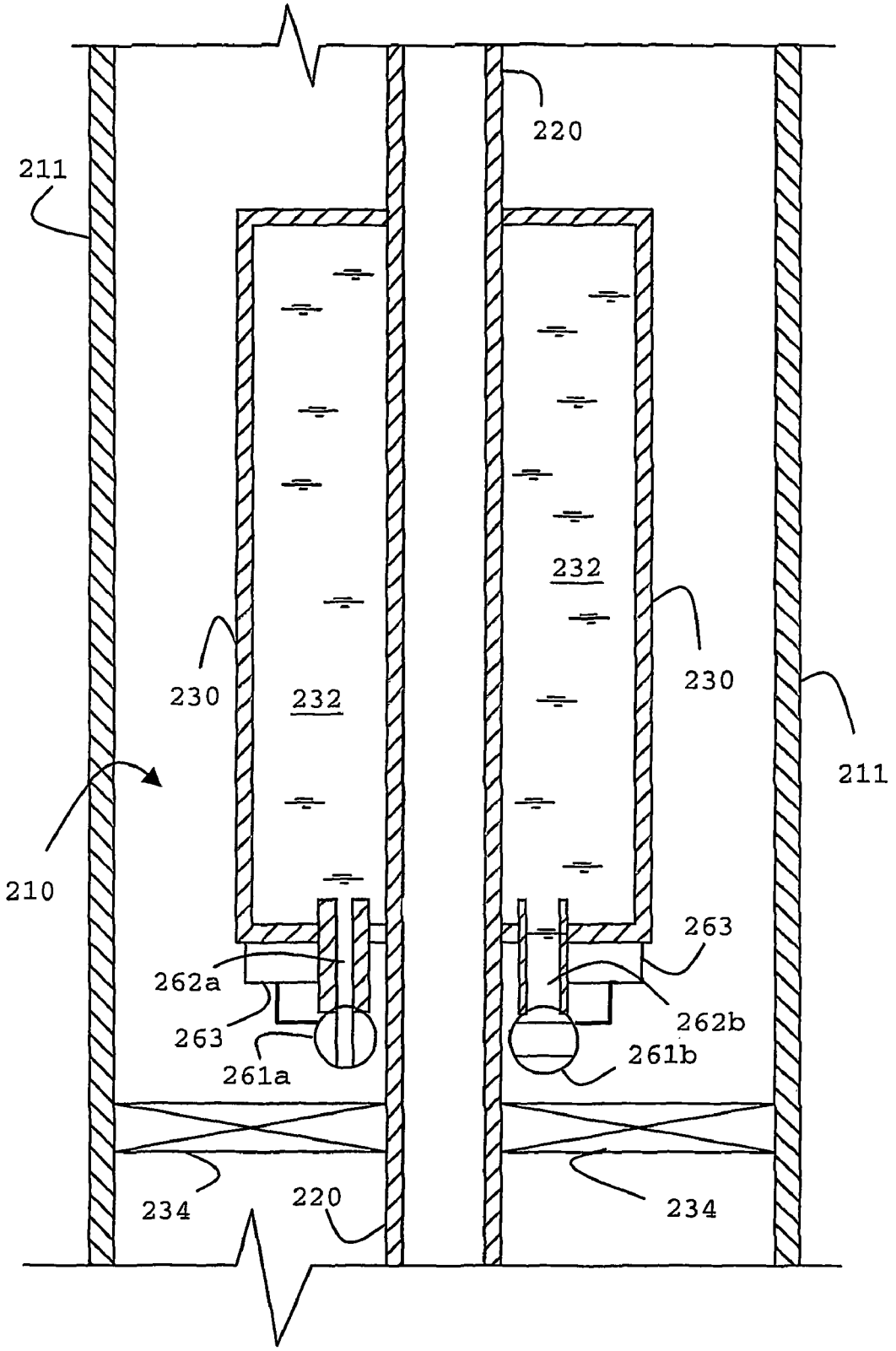
FIG. 2 shows elements of a variant of the novel telemetry system.

For example in FIG. 2, the phase-shifting device forms part of a sub 210 to be included into a work string 220 or the like. The volume 232 of the Helmholtz resonator is enclosed between a section of the work string 220 and a cylindrical enclosure 230 surrounding it. Tubes 262*a,b* of different lengths and/or diameter provide openings to the wellbore. Valves 261*a,b* open or close these openings in response to the control signals of a telemetry unit 263. A packer 234 reflects the incoming waves with phase shifts that depend on the state of the valves 261*a,b*.

The volume 232 and the inlet tubes 262*a,b* are shown pre-filled with a liquid, which may be water, silicone oil, or any other suitable low-viscosity liquid. Appropriate dimensions for inlet tubes 262 and the volume 232 can be selected in accordance with equations [1]-[3] to suit different resonance frequency requirements. With the choice of different tubes 262*a,b*, the device can be operated at an equivalent number of different carrier wave frequencies.

In the following example the novel telemetry system is implemented as a coiled tubing unit deployable from the surface. Coiled tubing is an established technique for well intervention and other operations. In coiled tubing a reeled continuous pipe is lowered into the well. In such a system the acoustic channel is created by filling the coiled tubing with a suitable liquid. Obviously the advantage of such a system is its independence from the specific well design, in particular from the existence or non-existence of a liquid filled annulus for use as an acoustic channel.

Figure 3A:
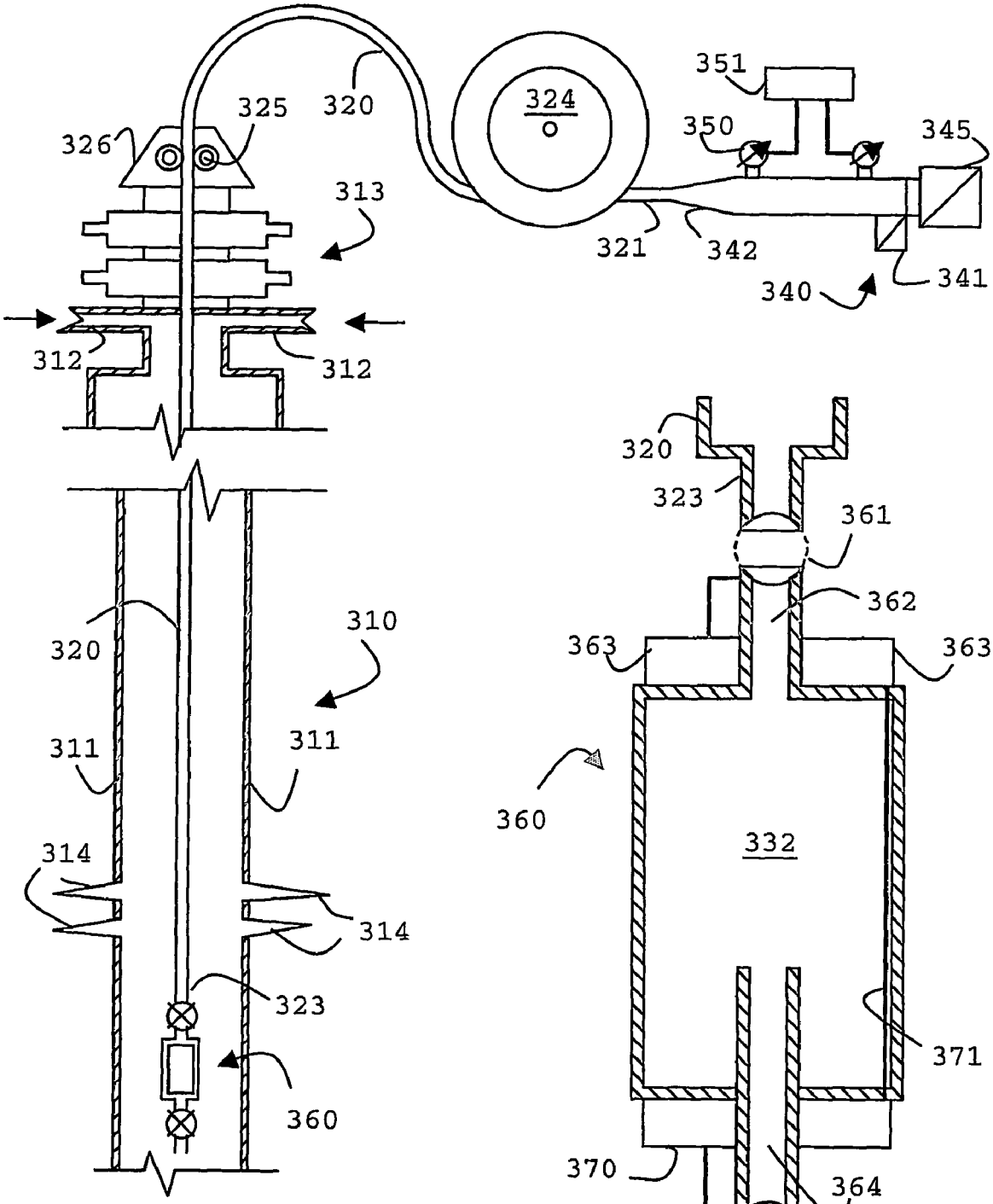
FIGS. 3A,B show another telemetry system in accordance with the invention for deployment on coiled tubing during stimulation operations.

A first variant of this embodiment is shown in FIG. 3. In FIG. 3A, there is shown a borehole 310 surrounded by casing pipes 311. It is assumed that no production tubing has been installed. Illustrating the application of the novel system in a well stimulation operation, pressurized fluid is pumped through a treat line 312 at the well head 313 directly into the cased bore hole 310. The stimulation or fracturing fluid enters the formation through the perforation 314 where the pressure causes cracks allowing improved access to oil bearing formations. During such a stimulation operation it is desirable to monitor locally, i.e., at the location of the perforations, the changing wellbore conditions such as temperature and pressure in real time, so as to enable an operator to control the operation on the basis of improved data.

The telemetry tool includes a surface section 340 preferably attached to the surface end 321 of the coiled tubing 320. The surface section includes an acoustic source unit 341 that generates waves in the liquid filled tubing 320. The acoustic source 341 on surface can be a piston source driven by electro-dynamic means, or even a modified piston pump with small piston displacement in the range of a few millimeters. Two sensors 350 monitor amplitude and/or phase of the acoustic waves traveling through the tubing. A signal processing and decoder unit 351 is used to decode the signal after removing effects of noise and distortion, and to recover the down-hole data. A transition section 342, which has a gradually changing diameter, provides acoustic impedance match between the coiled tubing 320 and the instrumented surface pipe section 340.

Figure 3B:
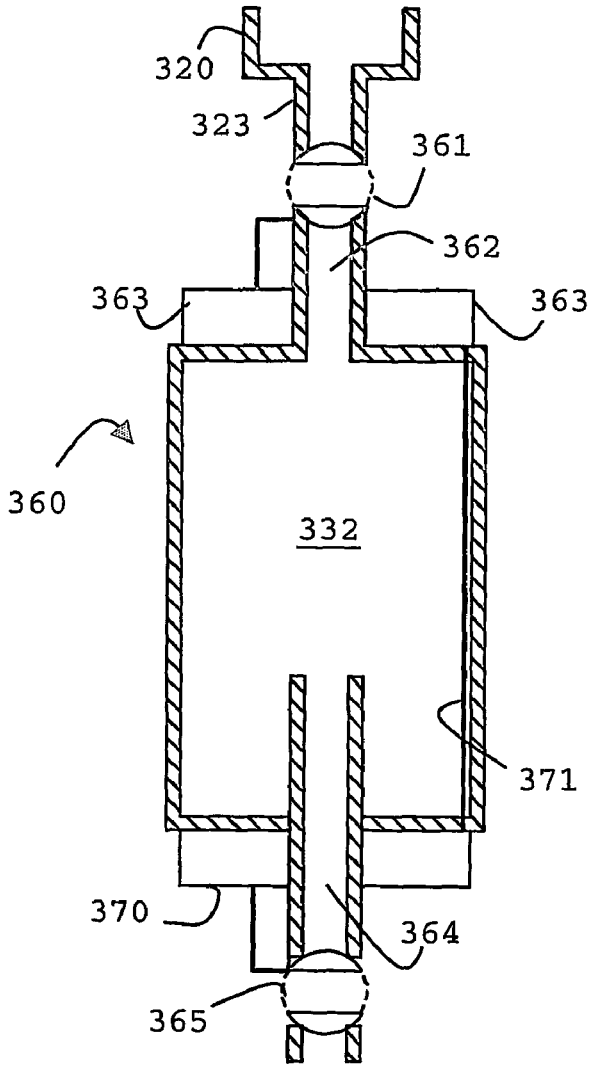

At the distant end 323 of the coiled tubing there is attached a monitoring and telemetry sub 360, as shown in detail in FIG. 3B. The sub 360 includes a flow-through tube 364, a lower control valve 365, down-hole gauge and electronics assembly 370, which contains pressure and temperature gauges, data memory, batteries and an additional electronics unit 363 for data acquisition, telemetry and control, a liquid volume or compliance 332, a throat tube 362 and an upper control/modulation valve 361 to perform the phase shifting modulation. The electronic unit 363 contains an electromechanical driver, which drives the control/modulation valve 361. In case of a solenoid valve, the driver is an electrical one that drives the valve via a cable connection. Another cable 371 provides a link between the solenoid valve 365 and the unit 363.

The coiled tubing 320, carrying the down-hole monitoring/telemetry sub 360, is deployed through the well head 313 by using a tubing reel 324, a tubing feeder 325, which is mounted on a support frame 326. Before starting data acquisition and telemetry, both valves 361, 365 are opened, and a low attenuation liquid, e.g. water, is pumped through the coiled tubing 320 by the main pump 345, until the entire coiled tubing and the liquid compliance 332 are filled with water. The lower valve 365 is then shut maintaining a water filled continuous acoustic channel. Ideally the down-hole sub is positioned well below the perforation to avoid high speed and abrasive fluid flow. The liquid compliance (volume) 332 and the throat tube 362 together form a Helmholtz resonator, whose resonance frequency is designed to match the telemetry frequency from the acoustic source 341 on the surface.

The modulation valve 361, when closed, provides a high impedance termination to the acoustic channel, and acoustic wave from the surface is reflected at the valve with little change in its phase. When the valve is open, the Helmholtz resonator provides a low termination to the channel, and the reflected wave has an added phase shift of close to 180°. Therefore the valve controlled by a binary data code will produce an up-going (reflected) wave with a BPSK modulation.

After the stimulation job, the in-well coiled tubing system can be used to clean up the well. This can be done by opening both valves 361, 362 and by pumping an appropriate cleaning fluid through the coiled tubing 320.

Coiled tubing system, as described in FIG. 3, may also be used to establish a telemetry channel through production tubing or other down-hole installations.

In the above examples of the telemetry system the reflected signals monitored on the surface are generally small compared to the carrier wave signal. The reflected and phase-modulated signal, due to the attenuation by the channel, is much weaker than this background interference. Ignoring the losses introduced by the non-ideal characteristics of the down-hole modulator, the amplitude of the signal is given by:

$$A_r = A_s 10^{-2\alpha L/20} \quad [4]$$

where $A_r$ and $A_s$ are the amplitudes of the reflected wave and the source wave, both at the receiver, $\alpha$ is the wave attenuation coefficient in dB/Kft and 2 L is the round trip distance from surface to down-hole, and then back to the surface. Assuming a water filled annulus with $\alpha$=1 dB/kft at 25 Hz, then for a well of 10 kft depth, then $A_r$=0.1$A_s$, or the received wave amplitude is attenuated by 20 dB compared with the source wave.

The plot shown in FIG. 4A shows a simulated receiver spectrum for an application with 10 kft water filled annulus. A carrier and resonator frequency of 20 Hz is assumed. The phase modulation is done by randomly switching (at a frequency of 10 Hz) between the reflection coefficient of a down-hole packer (0.9) and that of the Helmholtz resonator (−0.8). The effect is close to a BPSK modulation. The background source wave (narrow band peak at 20 Hz) interferes with the BPSK signal spectrum which is shown in FIG. 4B.

Signal processing can be used to receive the wanted signal in the presence of such a strong sinusoidal tone from the source. A BPSK signal v(t) can be described mathematically as follows $$v(t) = d(t) A_v \cos(\omega_c t) \quad [5]$$

where $d(t) \in \{+1, -1\}$=binary modulation waveform $A_v$=signal amplitude and $\omega_c$=radian frequency of carrier wave.

The source signal at the surface has the form $$s(t) = A_s \cos(\omega_c t) \quad [6]$$

The received signal r(t) at surface is the sum of the source signal and the modulated signal.

$$\begin{aligned} r(t) &= d(t) A_v \cos(\omega_c t) + A_s \cos(\omega_c t) \\ &= A_s \left[1 + \frac{A_v}{A_s} d(t)\right] \cos(\omega_c t) \end{aligned} \quad [7]$$

Equation [7] has the form of an amplitude modulated signal with binary digital data as the modulating waveform. Thus a receiver for amplitude modulation can be used to recover the transmitted data waveform d(t).

Alternatively, since the modulated signal and carrier source waves are traveling in opposite directions, a directional filter, e.g. the differential filter used in mud pulse telemetry reception as shown for example in the U.S. Pat. Nos. 3,742,443 and 3,747,059, could be used to suppress the source tone from the received signal. The data could then be recovered using a BPSK receiver.

It is likely that the modulated received signal will be distorted when it reaches the surface sensors, because of wave reflections at acoustic impedance changes along the annulus channel as well as at the bottom of the hole and the surface. A form of adaptive channel equalization will be required to counteract the effects of the signal distortion.

The down-hole modulator works by changing the reflection coefficient at the bottom of the annulus so as to generate phase changes of 180 degrees, i.e. having a reflection coefficient that varies between +1 and −1. In practice the reflection coefficient $\gamma$ of the down-hole modulator will not produce exactly 180 degree phase changes and thus will be of the form $$\begin{aligned} \gamma &= G_0 e^{j\theta_0}, \quad d(t) = 0 \\ &= G_1 e^{j\theta_1}, \quad d(t) = 1 \end{aligned}, \quad [8]$$

where $G_0$ and $G_1$ are the magnitudes of the reflection coefficients for a "0" and "1" respectively. Similarly, $\theta_0$ and $\theta_1$ are the phase of the reflection coefficients.

A more optimum receiver for this type of signal could be developed that estimates the actual phase and amplitude changes from the received waveform and then uses a decision boundary that is the locus of the two points in the received signal constellation to recover the binary data.

Figure 5A:
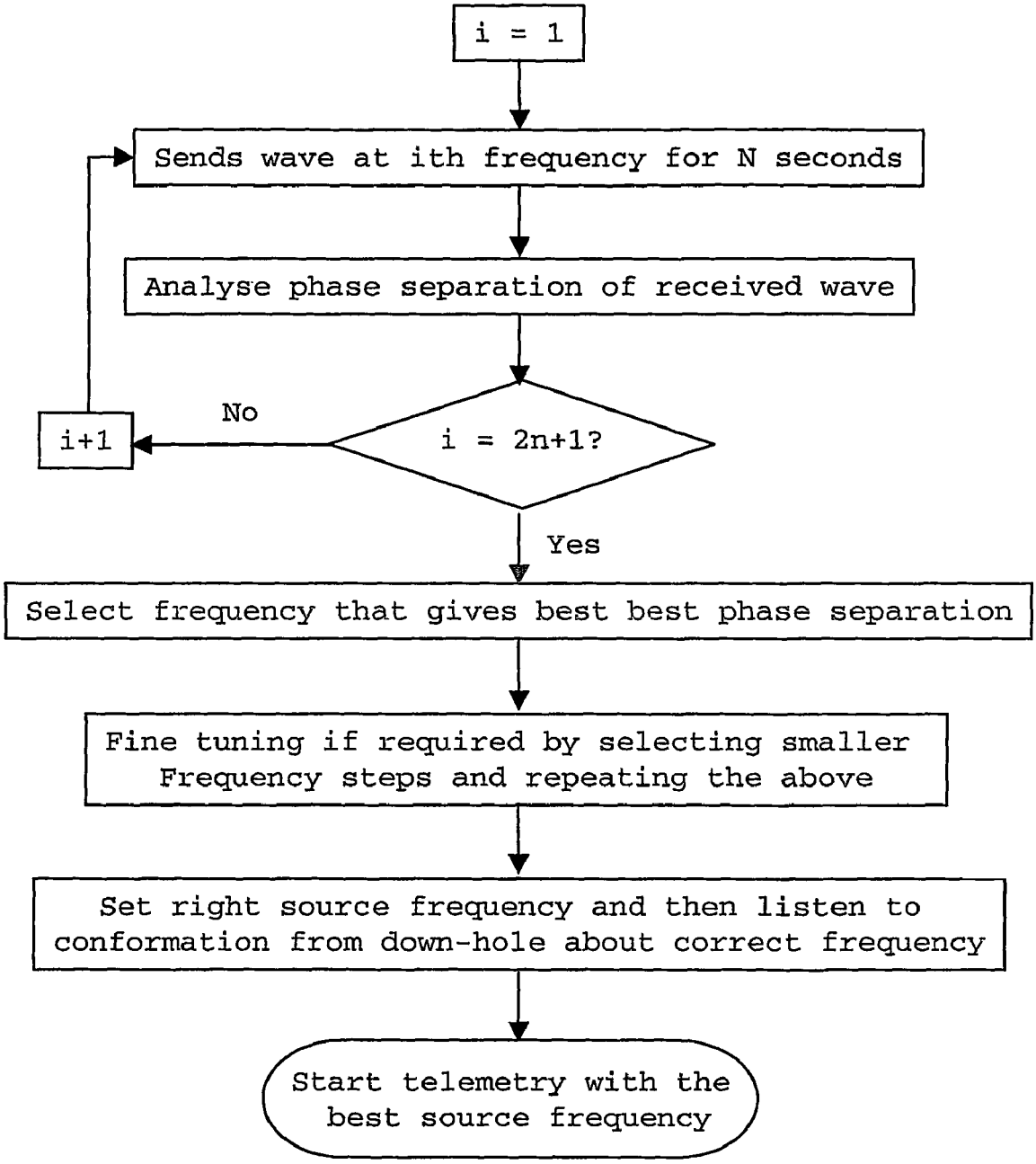
FIGS. 5A,B are flow charts illustrating a tuning method for a telemetry system in accordance with the present invention.
Figure 5B:
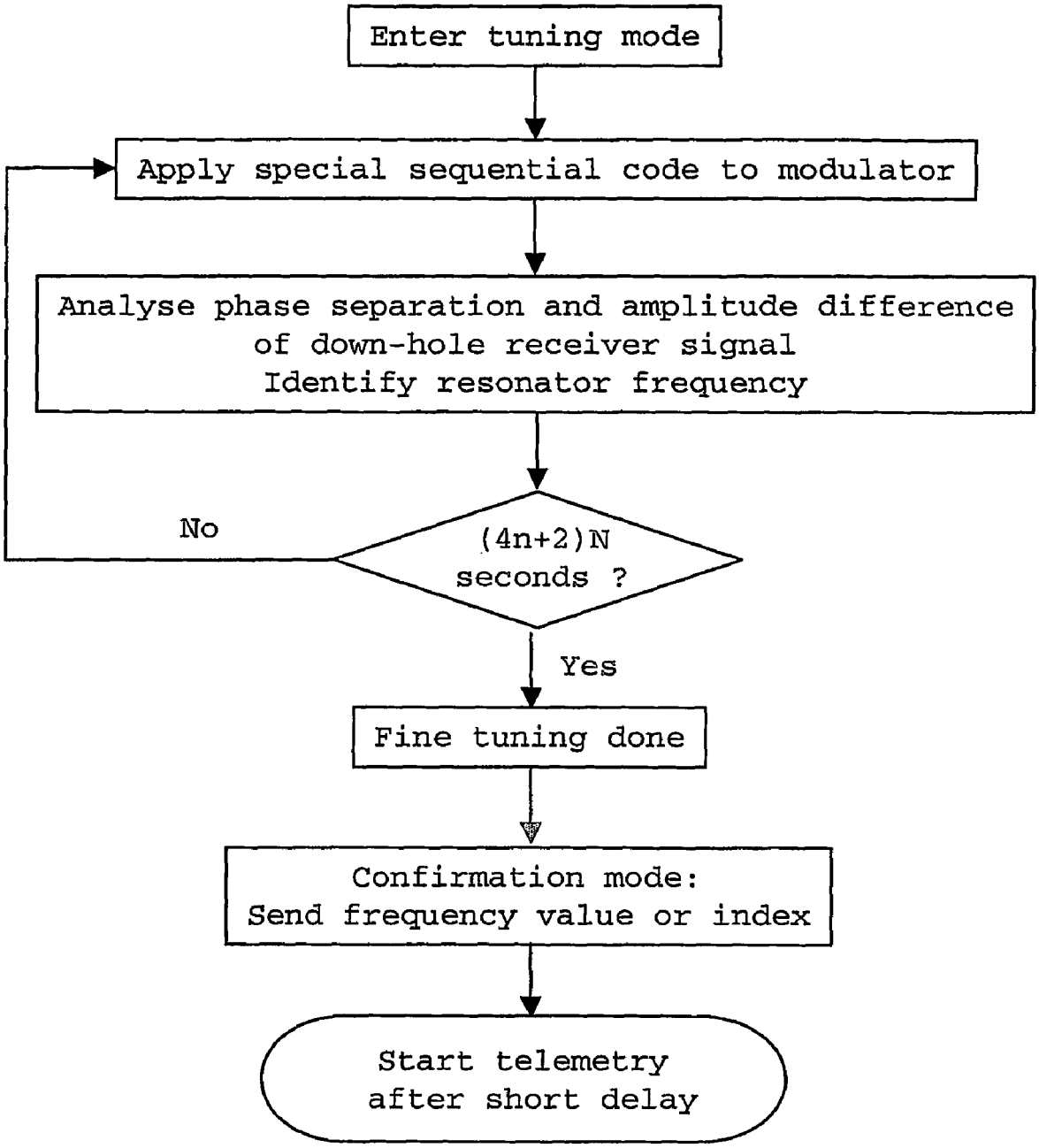

Design tolerances and changes in down-hole conditions such as temperature, pressure may cause mismatch in source and resonator frequencies in practical operations, affecting the quality of modulation. To overcome this, a tuning procedure can be run after the deployment of the tool down-hole and prior to the operation and data transmission. FIGS. 5A,B illustrate the steps of an example of such a tuning procedure, with FIG. 5A detailing the steps performed in the surface units and FIG. 5B those preformed by the down-hole units.

The down-hole modulator is set to a special mode that modulates the reflected wave with a known sequence of digits, e.g. a square wave like sequence. The surface source then generates a number of frequencies in incremental steps, each last a short while, say 10 seconds, covering the possible range of the resonator frequency. The surface signal processing unit analyzes the received phase modulated signal. The frequency at which the maximum difference between digit "1" and digit "0" is achieved is selected as the correct telemetry frequency.

Further fine-tuning may be done by transmitting frequencies in smaller steps around the frequency selected in the first pass, and repeating the process. During such a process, the down-hole pressure can also be recorded through an acoustic down-hole receiver. The frequency that gives maximum difference in down-hole wave phase (and minimum difference in amplitude) between digit state "1" and "0" is the right frequency. This frequency can be sent to the surface in a "confirmation" mode following the initial tunings steps, in which the frequency value, or an index number assigned to such frequency value, is encoded on to the reflected waves and sent to the surface.

The test and tuning procedure may also help to identify characteristics of the telemetry channel and to develop channel equalization algorithm that could be used to filter in the received signals.

The tuning process can be done more efficiently if a down-link is implemented. Thus once it identifies the right frequency, the surface system can inform the down-hole unit to change mode, rather than to continue the stepping through all remaining test frequencies.

A consideration affecting the applicability of the novel telemetry system relates to the power consumption level of the down-hole phase switching device, and the capacity of the battery or energy source that is required to power it.

In a case where the power consumption of an on-off solenoid valve prevents its use in the down-hole phase switching device, an alternative device can be implemented using a piezoelectric stack that converts electrical energy into mechanical displacement.

Figure 6:
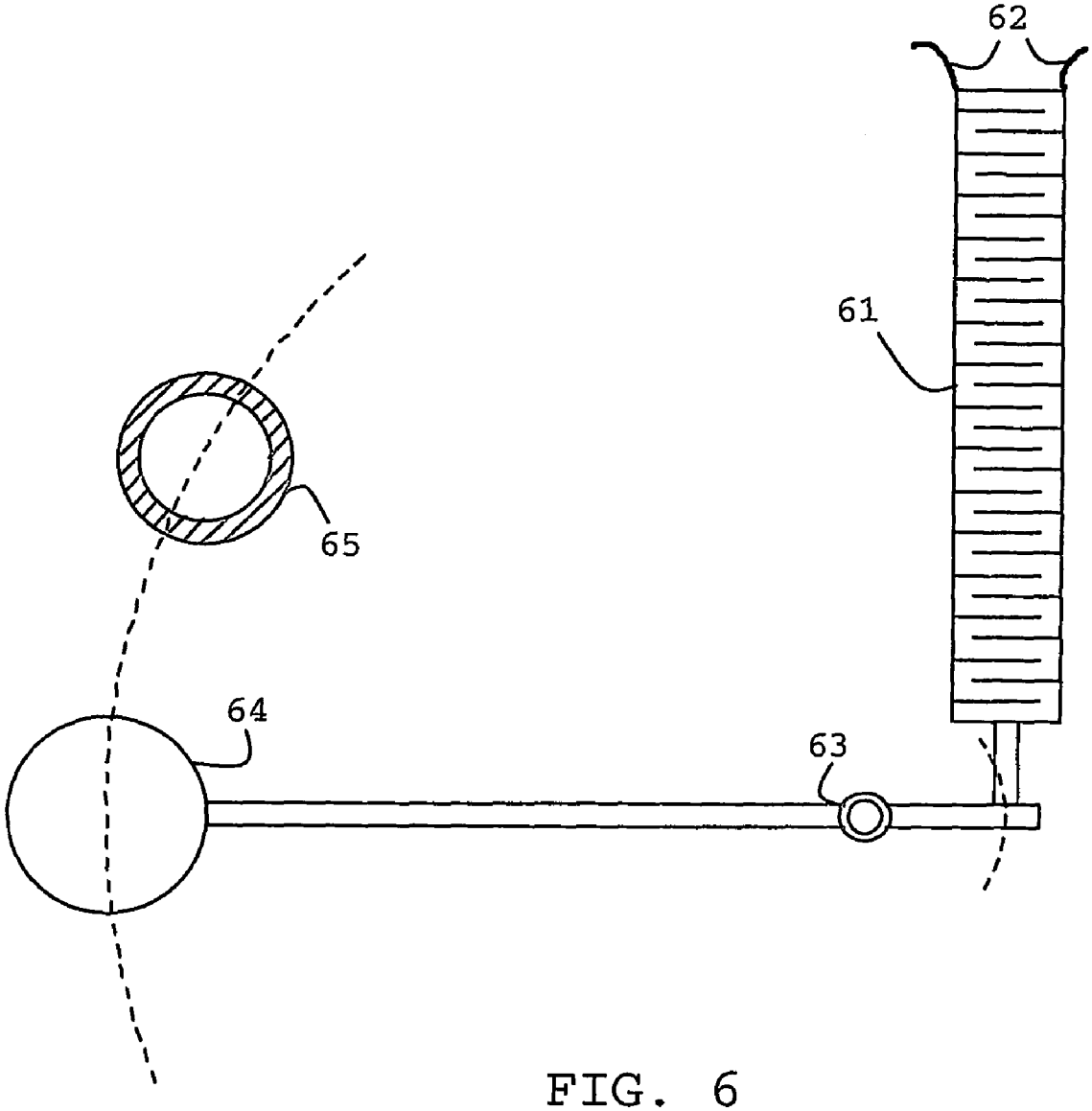
FIG. 6 illustrates an element of a telemetry system in accordance with the present invention with low power consumption.

In FIG. 6, there is shown a schematic diagram of elements used in a piezoelectrically operated valve. The valve includes stack 61 of piezoelectric discs and wires 62 to apply a driving voltage across the piezoelectric stack. The stack operates an amplification system 63 that converts the elongation of the piezoelectric-element into macroscopic motion. The amplification system can be based on mechanical amplification as shown or using a hydraulic amplification as used for example to control fuel injectors for internal combustion engines. The amplification system 63 operates the valve cover 64 so as to shut or open an inlet tube 65. The drive voltage can be controlled by a telemetry unit, such as 163 in FIG. 1.

Though the power consumption of the piezoelectric stack is thought to be lower than for a solenoid system, it remains a function of the data rate and the diameter of the inlet tube, which typically ranges from a few millimeters to a few centimeters.

Additionally, electrical coils or magnets (not shown) may be installed around the inlet tube 65. When energized, they produce an electromagnetic or magnetic force that pulls the valve cover 64 towards the inlet tube 65, and thus ensuring a tight closure of the inlet.

Figure 7A:
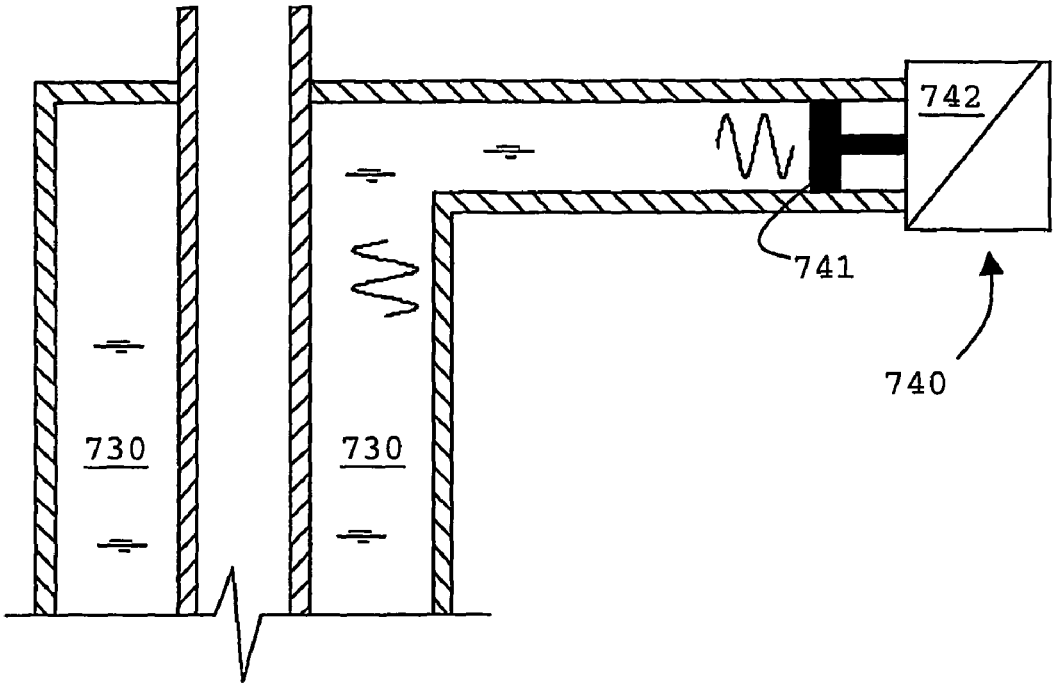
FIGS. 7A,B are schematic drawings of elements of a down-hole power source.

The use of a strong acoustic source on the surface enables an alternative to down-hole batteries as power supply. The surface system can be used to transmit power from surface in the form of acoustic energy and then convert it into electric energy through a down-hole electro-acoustic transducer. In FIGS. 7A,B there is shown a power generator that is designed to extract electric energy from the acoustic source.

A surface power source 740, which operates at a frequency that is significantly different from the telemetry frequency, sends an acoustic wave down the annulus 730. Preferably this power frequency is close to the higher limit of the first pass-band, e.g. 40~60 Hz, or in the $2^{nd}$ or $3^{rd}$ pass-band of the annulus channel, say 120 Hz but preferably below 200 Hz to avoid excessive attenuation. The source can be an electro-dynamic or piezoelectric bender type actuator, which generates a displacement of at least a few millimeters at the said frequency. It could be a high stroke rate and low volume piston pump, which is adapted as an acoustic wave source.

Figure 7A:
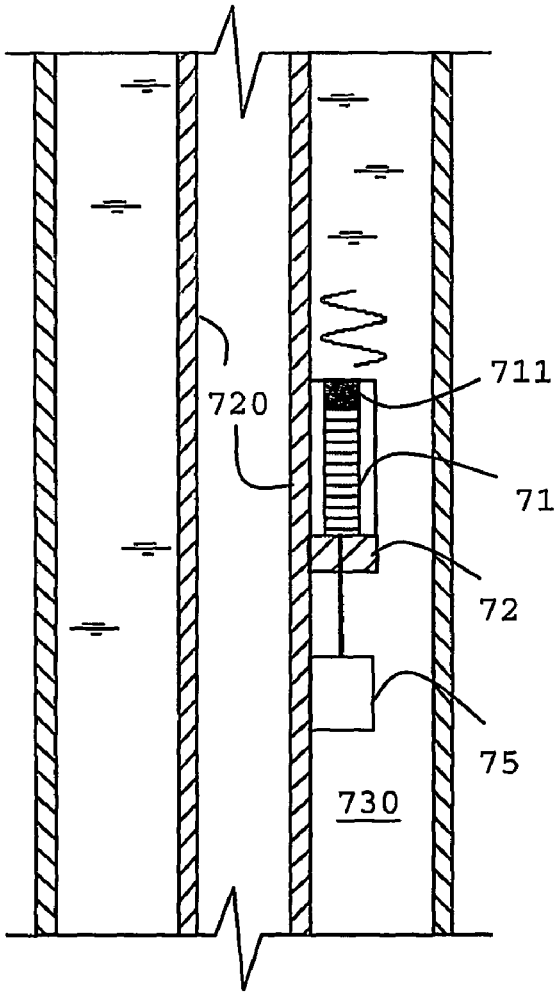

In the example of FIG. 7, the electrical to mechanic energy converter 742 drives the linear and harmonic motion of a piston 741, which compresses/de-compresses the liquid in the annulus. The source generates in the annulus 730 an acoustic power level in the region of a kilowatt corresponding to a pressure amplitude of about 100 psi (0.6 MPa). Assuming an attenuation of 10 dB in the acoustic channel, the down-hole pressure at 10 Kft is about 30 psi (0.2 MPa) and the acoustic power delivered to this depth is estimated to be approximately 100 W. Using a transducer with mechanical to electrical conversion efficiency of 0.5, 50 W of electrical power could be extracted continuously at the down-hole location.

Figure 7B:
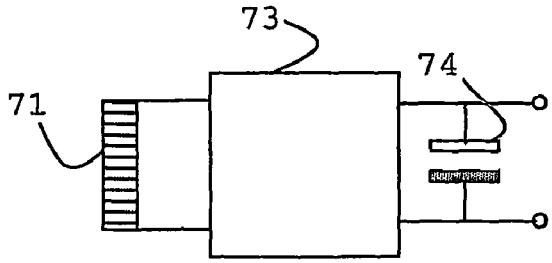

As shown in FIG. 7A, the down-hole generator includes a piezoelectric stack 71, similar to the one illustrated in FIG. 6. The stack is attached at its base to a tubing string 720 or any other stationary or quasi-stationary element in the well through a fixing block 72. A pressure change causes a contraction or extension of the stack 71. This creates an alternating voltage across the piezoelectric stack, whose impedance is mainly capacitive. The capacitance is discharged through a rectifier circuit 73 and then is used to charge a large energy storing capacitor 74 as shown in FIG. 7B. The energy stored in the capacitor 74 provides electrical power to down-hole devices such as the gauge sub 75.

The efficiency of the energy conversion process depends on the acoustic impedance match (mechanical stiffness match) between the fluid wave guide 720 and the piezoelectric stack 71. The stiffness of the fluid channel depends on frequency, cross-sectional area and the acoustic impedance of the fluid. The stiffness of the piezoelectric stack 71 depends on a number of factors, including its cross-section (area) to length ratio, electrical load impedance, voltage amplitude across the stack, etc. An impedance match may be facilitated by attaching an additional mass 711 to the piezoelectric stack 71, so that a match is achieved near the resonance frequency of the spring-mass system.

Figure 8:
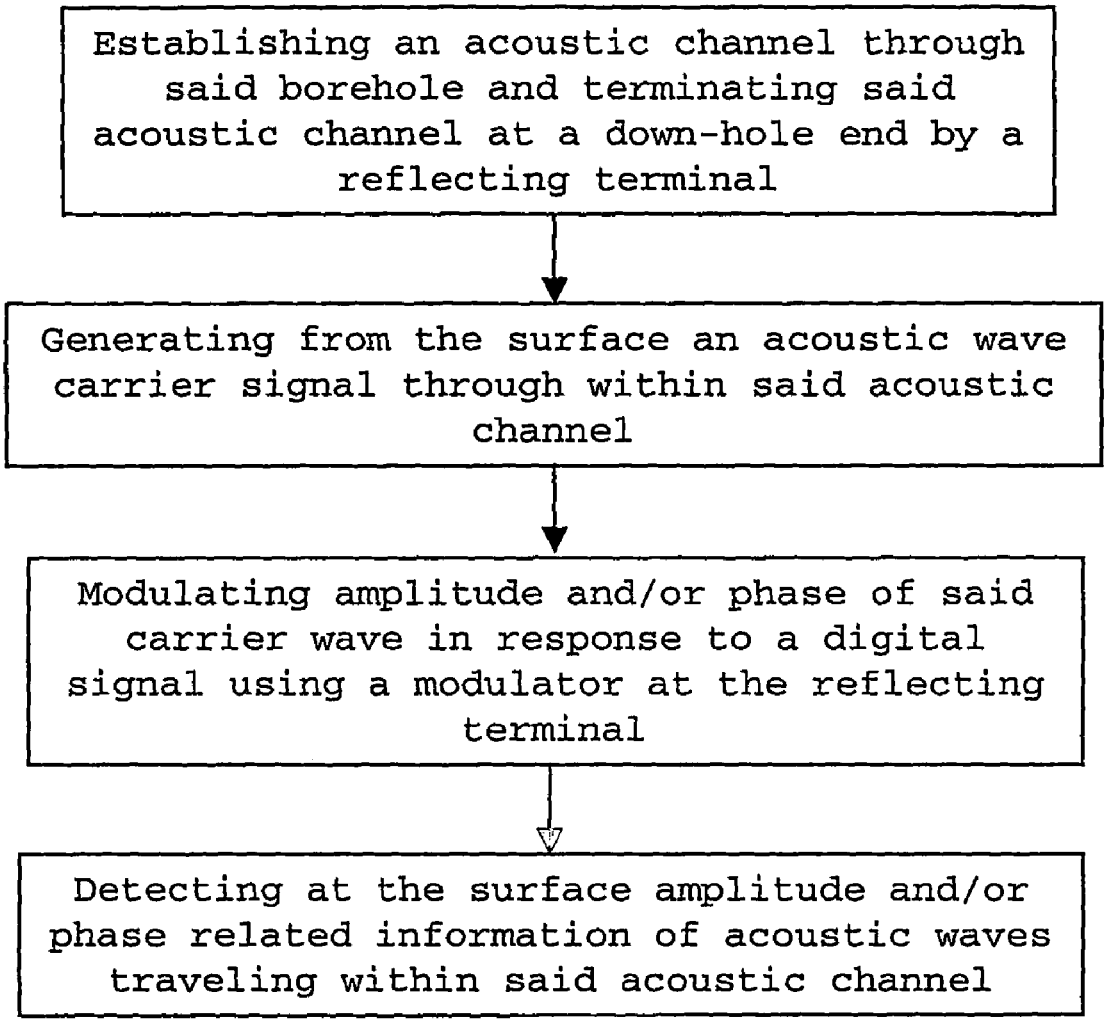
FIG. 8 is a flow diagram illustrating steps of a method in accordance with the invention.

FIG. 8 summarizes the steps described above.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. An acoustic telemetry apparatus for communicating digital data from a down-hole location through a borehole to the surface comprising:

an acoustic channel terminated at a down-hole end by a reflecting terminal;

an acoustic wave generator located at the surface and providing an acoustic wave carrier signal within said acoustic channel, wherein said signal is continuous;

a modulator which is configured to encode said digital data as phase modulation of the reflected carrier wave, and which comprises a resonator located in the vicinity of the reflecting terminal point at said down-hole location and a valve to open and close access to the resonator to modulate phase of said carrier wave in response to a digital signal, wherein the modulator and the reflecting terminal form a phase shifting reflector for the carrier wave, switchable between a first state in which the valve closes access to the resonator and closes the downhole end of the acoustic channel and reflects the carrier wave and a second state in which the valve opens access to the resonator which closes the downhole end of the acoustic channel and reflects the carrier wave with a shift in phase relative to reflection by said first state; and one or more sensors located at the surface adapted to detect information encoded as phase modulation of acoustic waves traveling within said acoustic channel and connected to a decoding unit adapted to convert the detected information into a digital signal.

2. The apparatus of claim 1 wherein the modulator switches the reflection properties of the reflecting terminal between a first state that causes the phase of an acoustic wave reflected at said terminal to invert and a second state that maintains the original phase of the incident wave.

3. The apparatus of claim 1 wherein the acoustic channel is a column of liquid extending from the surface to a down-hole location.

4. The apparatus of claim 3 wherein the acoustic channel is formed by filling an annular volume in the borehole with a liquid.

5. The apparatus of claim 3 wherein the acoustic channel is formed by filling a tubing string suspended in the borehole with a liquid.

6. The apparatus of claim 3 wherein the column of liquid has a viscosity of less than $3\times10^{-3}$ NS/m$^2$.

7. The apparatus of claim 1 wherein the resonator comprises a liquid filled volume enclosed in a housing having a tubular opening to the reflecting terminal.

8. The apparatus of claim 7 wherein the resonator has two or more tubular openings to the reflecting terminal.

9. The apparatus of claim 7 wherein the acoustic wave generator is adapted to simultaneously generate acoustic waves at different frequencies.

10. The apparatus of claim 1 further comprising an acoustic receiver in a down-hole location.

11. The apparatus of claim 1 wherein the sensors are connected to a signal processing unit adapted to filter the carrier wave signal from detected information.

12. The apparatus of claim 1 wherein the modulator comprises a piezoelectric actuator.

13. The apparatus of claim 1 comprising a down-hole power generator adapted to convert acoustic energy from an acoustic wave signal generated at the surface.

14. Use of the apparatus of claim 1 in a well stimulation operation.

15. The apparatus of claim 13, wherein the down-hole power generator is located within the annulus and comprises an electro-acoustic transducer adapted to convert the energy of the acoustic wave into electrical energy.

16. The apparatus of claim 15, further comprising:

an energy storing capacitor adapted to store the electrical energy and provide power to one or more down-hole devices.

17. The apparatus of claim 1 wherein the resonance frequency of the resonator is close to a frequency of the acoustic wave carrier signal.

18. The apparatus of claim 7 wherein the reflecting terminal is movable between positions which respectively open and close said housing to the acoustic channel, thereby switching between said first and second states.

19. The apparatus of claim 1 wherein the acoustic channel is liquid-filled coiled tubing suspended in the borehole.

20. A method of communicating digital data from a down-hole location through a borehole to the surface comprising the steps of:

establishing an acoustic channel through said borehole and terminating said acoustic channel at a down-hole end by a reflecting terminal;

generating from the surface an acoustic wave carrier signal within said acoustic channel;

encoding a digital bit stream as modulation of phase of the reflected carrier wave by switching the modulator and the reflecting terminal between a first state which closes the downhole end of the acoustic channel and reflects the carrier wave and a second state which also closes the downhole end of the acoustic channel and which reflects the carrier wave with a shift in phase relative to reflection by said first state; and detecting at the surface information encoded as phase modulation of acoustic waves traveling within said acoustic channel, thereby receiving at the surface the digital bit stream encoded as modulation of phase of the carrier wave.

21. The method of claim 20 further comprising the step of placing a Helmholtz resonator in proximity to the reflecting terminal and the step of encoding a digital bit stream as modulation of phase of said carrier wave comprises switching between a first state in which the resonator is closed thereby closing the downhole end of the acoustic channel and the reflecting terminal reflects the carrier wave and a second state in which the resonator is open to the acoustic channel and closes the downhole end of the acoustic channel so that the reflecting terminal reflects the carrier wave with a shift in phase relative to reflection by said first state.

22. The method of claim 20 further comprising the steps of performing measurements of down-hole parameters, and encoding said measurements into the digital bitstream.

23. The method of claim 20 further comprising the step of selecting the frequency of the carrier wave such that it is close to the resonance frequency of a resonator used to modulate said carrier wave.

24. The method of claim 20 further comprising the steps of scanning through a range of possible carrier frequencies;

monitoring at the surface reflected and modulated wave signal;

selecting the frequency of the carrier wave such that the detection of said reflected and modulated wave signal is optimized; and commencing the communication of down-hole measurements.

25. The method of claim 20 wherein the acoustic wave carrier signal is continuous.

26. The method of claim 20 further comprising placing a Helmholtz resonator in proximity to the reflecting terminal, selecting a frequency of the acoustic carrier wave such that it is close to the resonance frequency of said resonator and switching the reflecting terminal between said first and second states by switching between a first state in which the resonator is closed thereby closing the downhole end of the acoustic channel and the reflecting terminal reflects the carrier wave and a second state in which the resonator is open to the acoustic channel and closes the downhole end of the acoustic channel so that the reflecting terminal reflects the carrier wave with a shift in phase relative to reflection by said first state.

27. The method of claim 20 wherein establishing the acoustic channel comprises suspending liquid-filled coiled tubing in the borehole.

28. A method of stimulating a wellbore comprising the steps of performing operations designed to improve the production of said wellbore while simultaneously establishing an acoustic channel through said borehole and terminating said acoustic channel at a down-hole end by a reflecting terminal;

performing measurements of down-hole parameters;

encoding said measurements into a digital bit stream;

generating from the surface an acoustic wave carrier signal within said acoustic channel;

encoding the digital bit stream as modulation of phase of the reflected carrier wave by switching the reflecting terminal between a first state which closes the downhole end of the acoustic channel and reflects the carrier wave and a second state which also closes the downhole end of the acoustic channel and which reflects the carrier wave with a shift in phase relative to reflection by said first state; and detecting at the surface information encoded as phase modulation of acoustic waves traveling within said acoustic channel, thereby receiving at the surface the digital bit stream encoded as modulation of phase of the carrier wave.

29. The method of claim 28 wherein the acoustic wave carrier signal is continuous.

30. The method of claim 28 further comprising placing a Helmholtz resonator in proximity to the reflecting terminal, selecting a frequency of the acoustic carrier wave such that it is close to the resonance frequency of said resonator and switching the reflecting terminal between said first and second states by switching between a first state in which the resonator is closed thereby closing the downhole end of the acoustic channel and the reflecting terminal reflects the carrier wave and a second state in which the resonator is open to the acoustic channel and closes the downhole end of the acoustic channel so that the reflecting terminal reflects the carrier wave with a shift in phase relative to reflection by said first state.

* * * * *